US006061960A

United States Patent [19]

Korai

[11] Patent Number: 6,061,960

[45] Date of Patent: May 16, 2000

[54] REVOLVING DOOR

[76] Inventor: Noboru Korai, 2-Chome, Shinjuku-ku, Tokyo, 162-0825, Japan

[21] Appl. No.: 09/125,648

[22] PCT Filed: Dec. 12, 1997

[86] PCT No.: PCT/JP97/04577

§ 371 Date: Aug. 18, 1998

§ 102(e) Date: Aug. 18, 1998

[87] PCT Pub. No.: WO98/28514

PCT Pub. Date: Jul. 2, 1998

[30] Foreign Application Priority Data

Dec. 24, 1996 [JP] Japan ..... 8-355607

[51] Int. Cl.[7] ..... E05D 15/02

[52] U.S. Cl. ..... 49/42

[58] Field of Search ..... 49/42, 44, 45; 109/8, 64, 67, 71

[56] References Cited

U.S. PATENT DOCUMENTS 596,029 12/1897 Ife ..... 49/44
1,007,025 10/1911 Ely ..... 49/45
1,417,372 5/1922 Friedland .

FOREIGN PATENT DOCUMENTS 495227 10/1919 France .
1140300 7/1957 France .
17427 9/1895 United Kingdom ..... 49/42
WO 94/23167 10/1994 WIPO .

*Primary Examiner*—Jerry Redman
*Attorney, Agent, or Firm*—Christensen O'Connor Johnson & Kindness pllc

[57] ABSTRACT

A revolving door has opposed vertical sidewalls defining a passage space, opposed passage openings, and a door assembly including a vertical central axis and a plurality of door wings extending outwardly from the central axis. The opposed vertical sidewalls form opposed substantially flat surfaces. The plurality of door wings are adapted to eccentrically revolve about the vertical central axis, such that an outer extremity of at least one door wing is always in close sealing proximity with each of said opposed surfaces. Preferably, the sidewalls are comprised of opposed vertical substantially flat members. The door wings that eccentrically revolve within the passage space allow use of opposing substantially flat sidewalls in place of curved sidewalls.

17 Claims, 12 Drawing Sheets

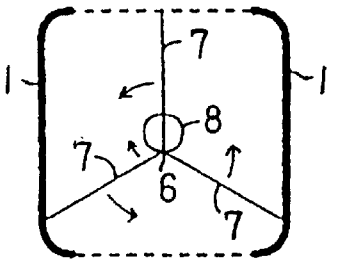
Fig. 9A.
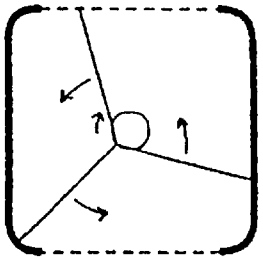
Fig. 9B.
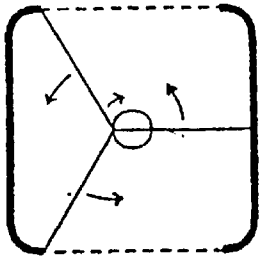
Fig. 9C.
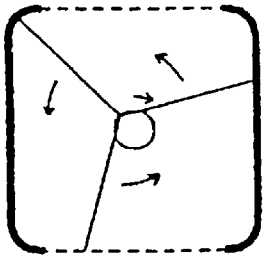
Fig. 9D.
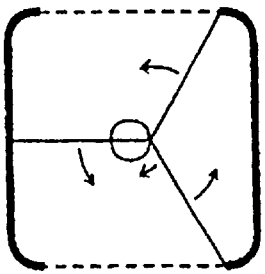
Fig. 9E.
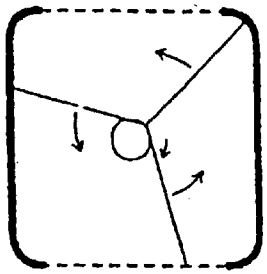
Fig. 9F.
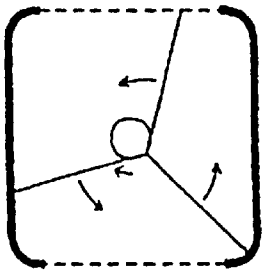
Fig. 9G.
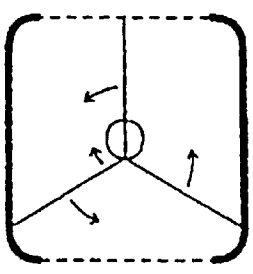
Fig. 9H.
Fig. 9I.

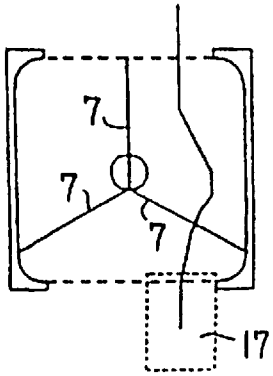
Fig. 10A.
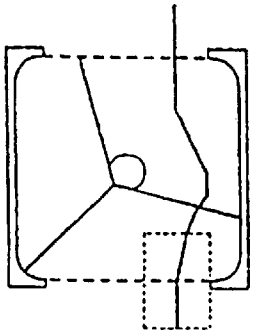
Fig. 10B.
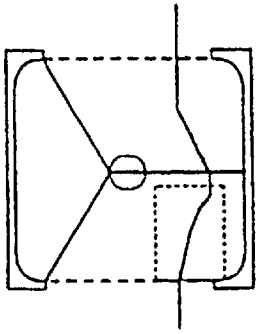
Fig. 10C.
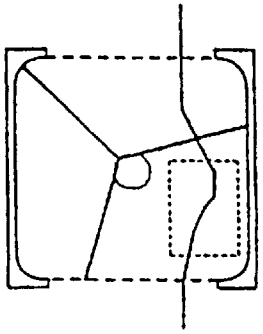
Fig. 10D.
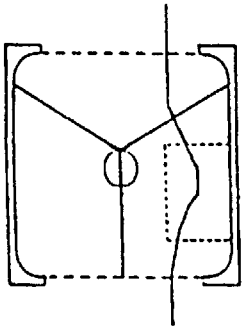
Fig. 10E.
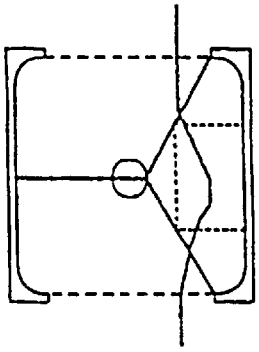
Fig. 10F.
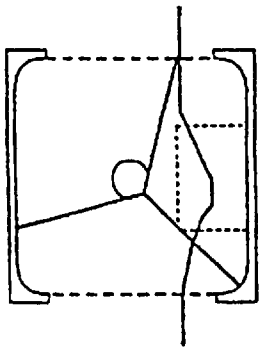
Fig. 10G.
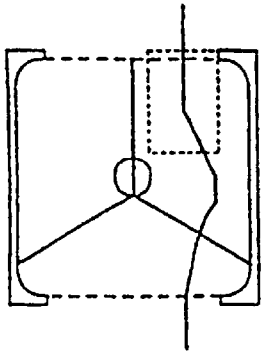
Fig. 10H.
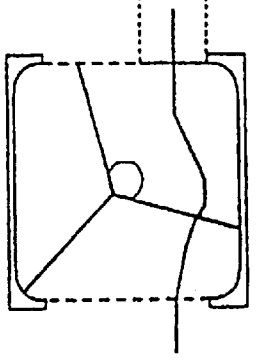
Fig. 10I.
Fig. 10J.

REVOLVING DOOR

FIELD OF THE INVENTION

The invention relates generally to a revolving door assembly.

BACKGROUND OF THE INVENTION

The revolving door is generally located at an entrance of building structures to prevent the direct flow of air through a passage space when a user passes through the entrance. The revolving door is also used as a security door which restricts access into a room to authorized personnel.

Referring now to FIG. 1, there is shown a perspective view of a conventional revolving door assembly. The conventional revolving door assembly comprises a cylindrical vestibule including opposed curved side walls defining a passage space and passage openings, a central axis, and a plurality of door wings extending outwardly from the central axis. The door wings are partially enclosed between the opposed curved side walls and revolve together about the common central axis within the passage space.

According to the conventional revolving door assembly having the cylindrical vestibule, since the side walls are comprised of curved or arcuate members, the conventional revolving door assembly has several disadvantages. For example, the curved or arcuate wall is relatively difficult to manufacture so that materials to be used for the side walls are limited because of technical and/or economical reasons. According to the conventional revolving door assembly, the two spaced cylindrical walls are disposed to partially enclose the cylindrical passage space to define two diametrically opposed passage openings which are relatively narrow. To widen the width of the passage opening, larger side walls and larger door wings should be used and the revolving door assembly becomes bulky. Otherwise, the number of door wings should be increased to correspond with a wider passage opening but a compartment defined by adjacent door wings becomes too small. In addition, because of the cylindrical configuration, it is difficult to mount a shutter assembly which is used for a robbery prevention purpose at the revolving door assembly.

An object of the present invention is to provide a revolving door in which the opposed curved side walls are replaced by opposed vertical side walls having opposed substantially flat or plane surfaces.

BRIEF DESCRIPTION OF THE INVENTION

According to the present invention, there is provided a revolving door having opposed vertical side walls defining a passage space and opposed passage openings, and a door assembly comprising a vertical central axis and a plurality of door wings extending outwardly from the central axis in which the side walls comprise opposed substantially flat surfaces, and the door assembly eccentrically revolves within the passage space such that an outer extremity of at least one door wing is always in close sealing proximity with each of said opposed surfaces. Preferably, the side walls are comprised of opposed vertical substantially flat members.

The door assembly which eccentrically revolves within the passage space enables to replace the curved side walls by the side walls having the opposed substantially flat or plane surfaces.

With the side walls having the opposed substantially flat surfaces, wider passage openings can be obtained. Since the side walls can be comprised of flat members which is simple to manufacture, a range of selection of materials to be used for the side wall is broaden. Since the passage openings define a vertical plane, the shutter assembly can easily be mounted at the revolving door assembly.

Other advantages of adopting flat side walls will be readily apparent from the drawings, discussion and description which follow.

BRIEF DESCRIPTION OF THE DRAWINGS

FIGS. 9A through 9I show a predetermined path of rotation of the door assembly in sequence;

FIGS. 10A through 10J show a path of wheel chair in sequence when the chair passes through the revolving door of the present invention;

DETAILED DESCRIPTION OF THE INVENTION

Figure 1:
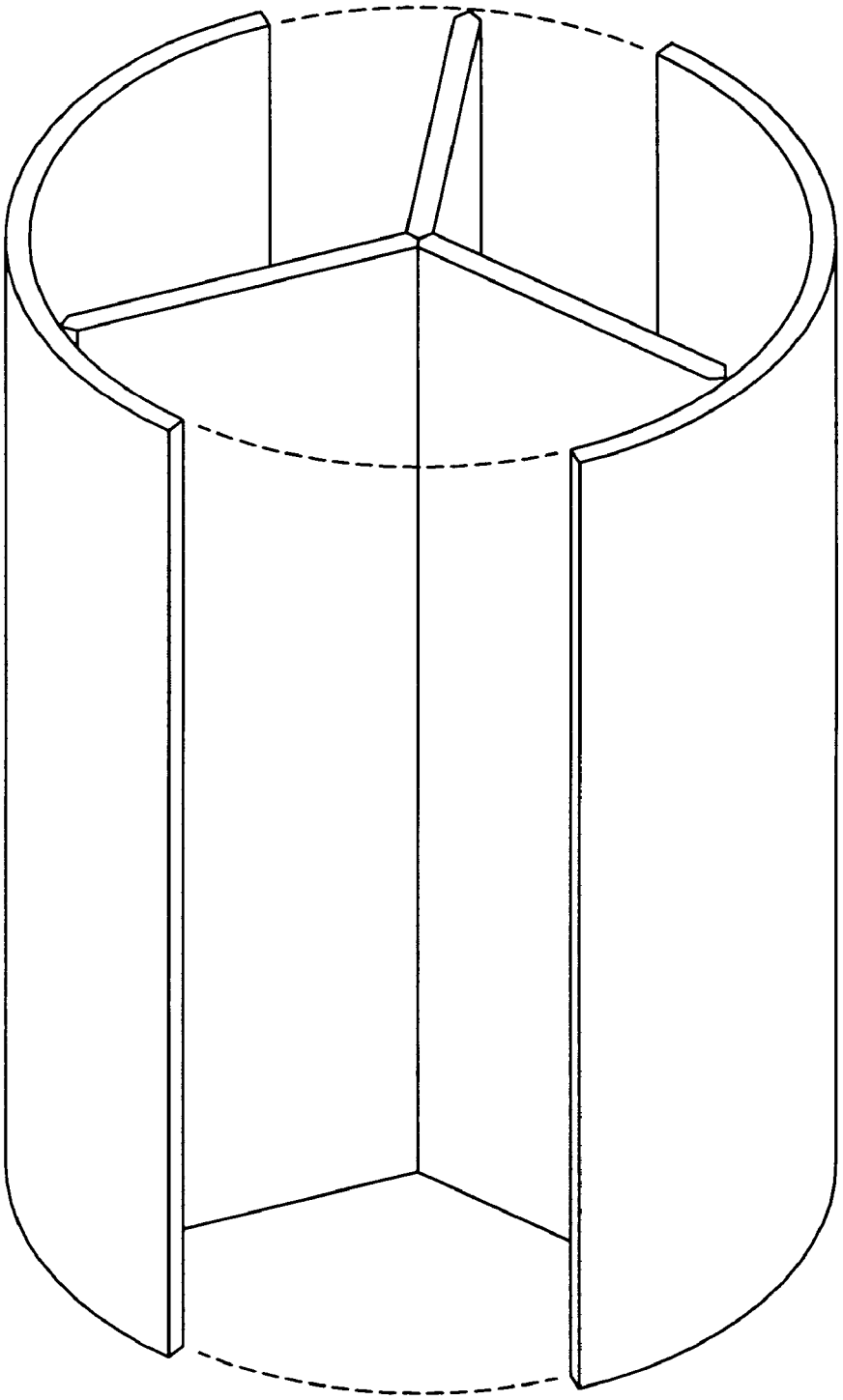
FIG. 1 is a perspective view of a conventional revolving door assembly.
Figure 2:
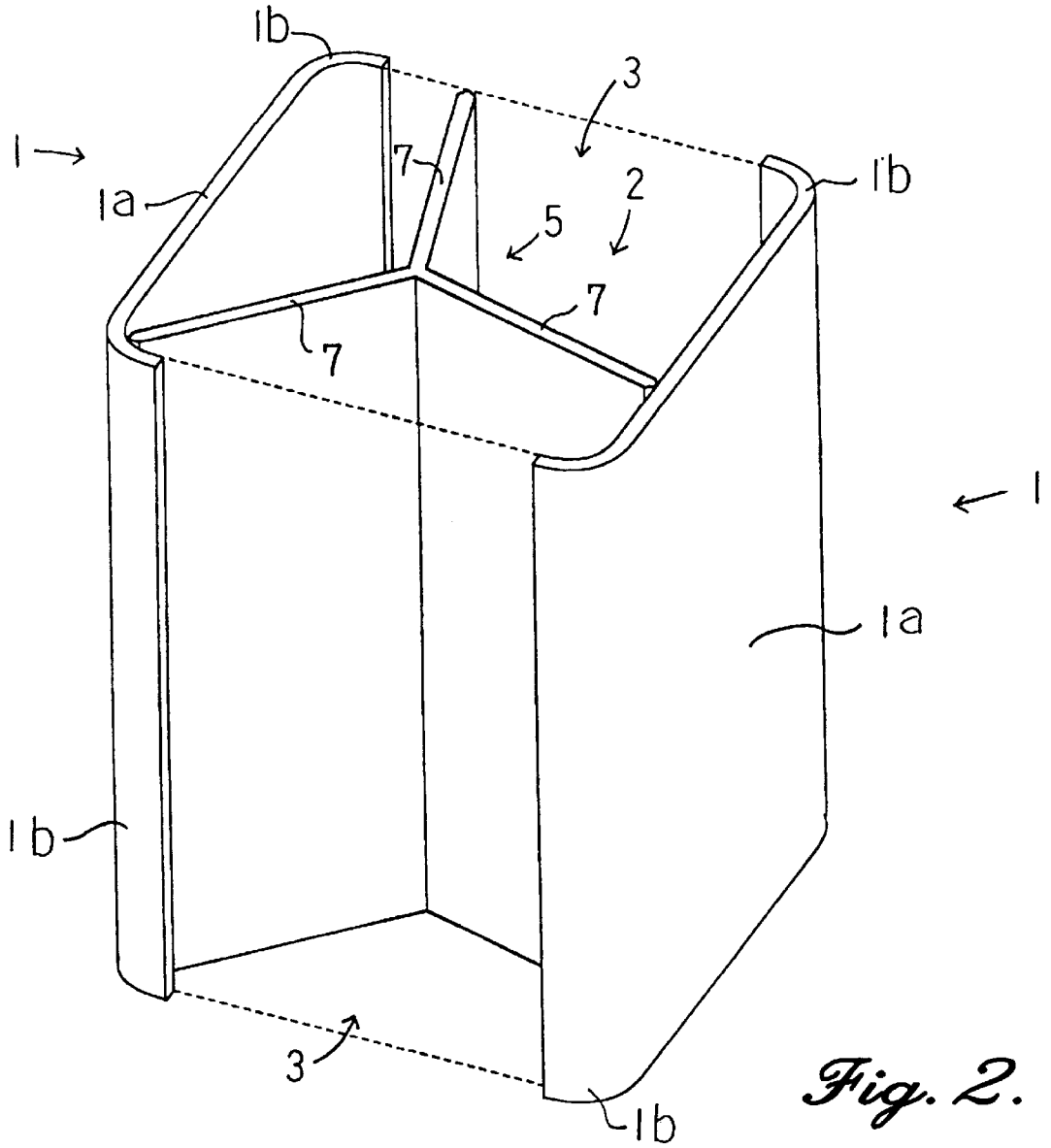
FIG. 2 is a perspective view of a revolving door in accord with the present invention in which means for revolving a door assembly is not shown.
Figure 3:
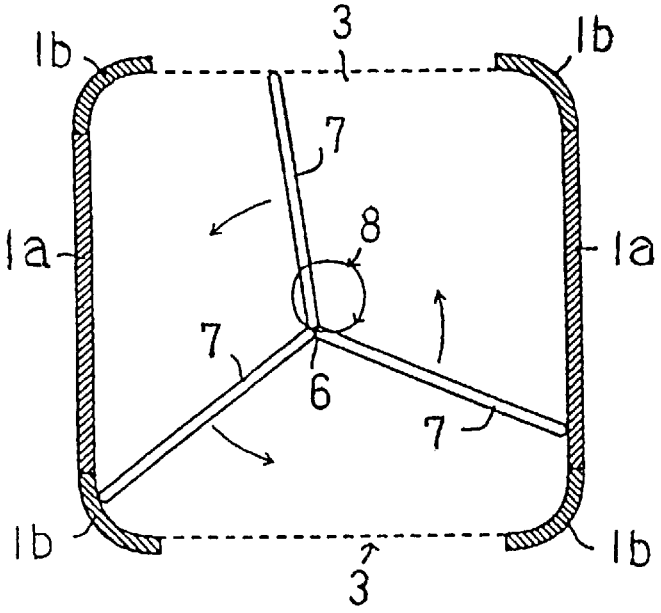
FIG. 3 is a plan view of the revolving door according to FIG. 2.
Figure 4:
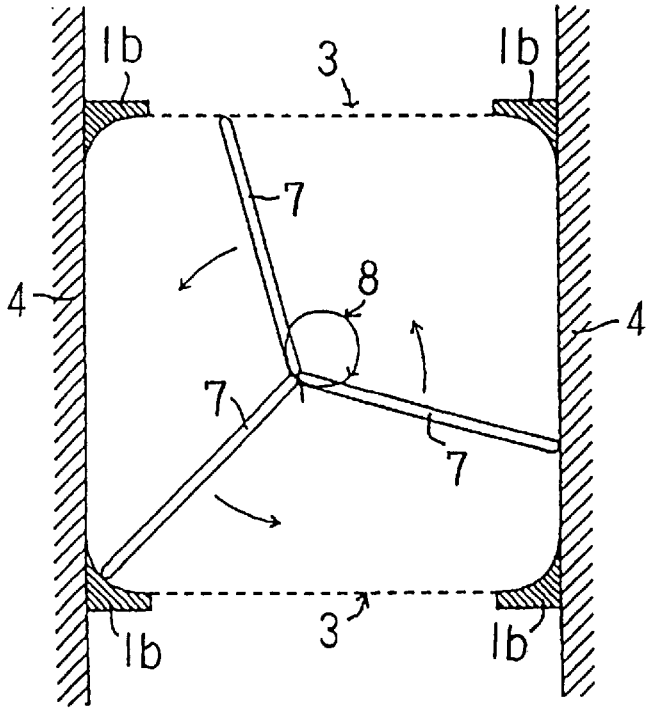
FIG. 4 is a plan view of another embodiment of the revolving door.

Referring to FIGS. 2 and 3, there are provided opposed vertical substantially flat side walls 1 which define a vestibule comprising a passage space 2 and opposed passage openings 3. The side walls 1 are comprised of generally upright plate-like portions 1*a* and corner portions 1*b* which have an inner curved surface and are provided at both sides of the flat portions 1*a*. The opposed planar side walls 1 have opposed and parallel flat or plane surfaces which define the passage space 2 therebetween. FIG. 4 shows another embodiment of the side walls in which the side walls of the revolving door are comprised of opposed side walls 4 of a corridor and the corner portions 1*b* attached to the side walls. In this regard, the revolving door of the present invention can be constructed by using opposed walls 4 which already exist in building structures.

A door assembly 5 comprises a vertical central axis 6 and three planar upright door wings 7 extending outwardly from the central axis 6. The door wings 7 are radially extending and arranged in equidistant space apart relationship about the central axis 6. The number of door wings 7 is not limited to the embodiment but three wings are preferred. The door assembly 5 is partially enclosed between the opposed flat side walls 1 and substantially turns horizontally within the passage space 2 defined by the opposed side walls 1. In particular, the door assembly 5 eccentrically revolves within the passage space 2 so that an outer end or extremity of at lease one door wing 7 is always in close sealing proximity with each side wall 1 thereby preventing the direct flow of air through the passage space 2. Sealing means (not shown in FIGS. 2 to 4) may be provided at outer extremities of the door wings 7 so that the sealing means may slightly contact an inner surface of the side wall 1 as the door assembly 5 revolves within the passage space 2.

Figure 5:
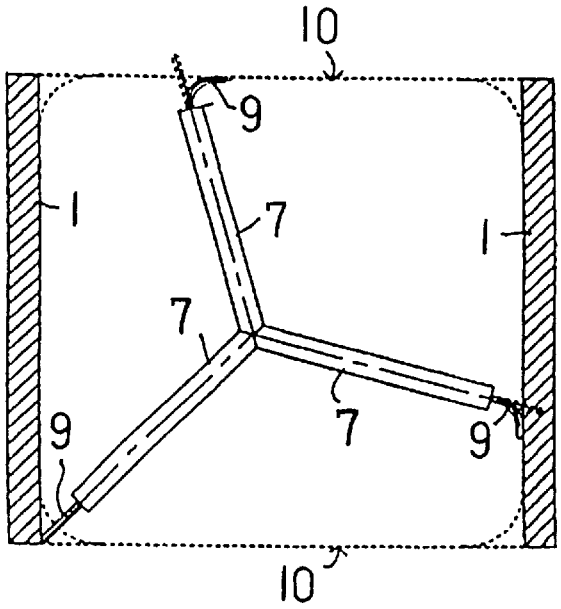
FIG. 5 is a plan view of a revolving door assembly of another embodiment in which corner portions are eliminated from the side walls.
Figure 6:
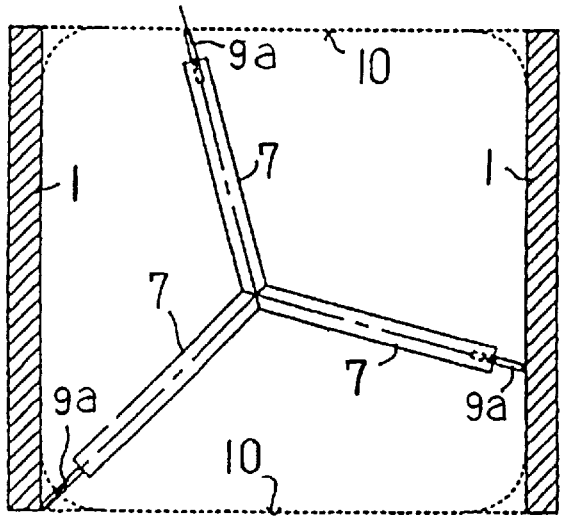
FIG. 6 is a plan view of a revolving door assembly of still another embodiment in which corner portions are eliminated from the side walls.

FIGS. 5 & 6 show another embodiment of the present invention in which the corner portions 1*b* are eliminated from the side walls 1. Referring to FIG. 5, a vertical resilient sealing member 9 is provided at the outer end of each door wing 7 and is extended outwardly from the extremity of the door wing 7. An upright wall 10 is provided above each passage opening 3 so that the sealing member 9 contacts the upright wall 10 and does not project from the plane of the opening 3. The upright wall 10 can be provided below the opening 3 or the upright walls 10 may be provided both above and below the opening 3. Referring to FIG. 6, a vertical retractable sealing member 9*a* is provided at the outer extremity of each door wing 7. The retractable sealing member 9*a* is biased toward an extending direction by a spring (not shown) for example. The upright wall 10 is provided above the opening 3 so that the sealing member 9*a* contacts the upright wall 10 and retracts toward the central axis 6 against the biased force. Instead of providing the retractable sealing member, variable length door wings which includes at least two sliding door elements slidingly movable relative to each other to vary the radial length of the door wings may be provided.

Figure 7:
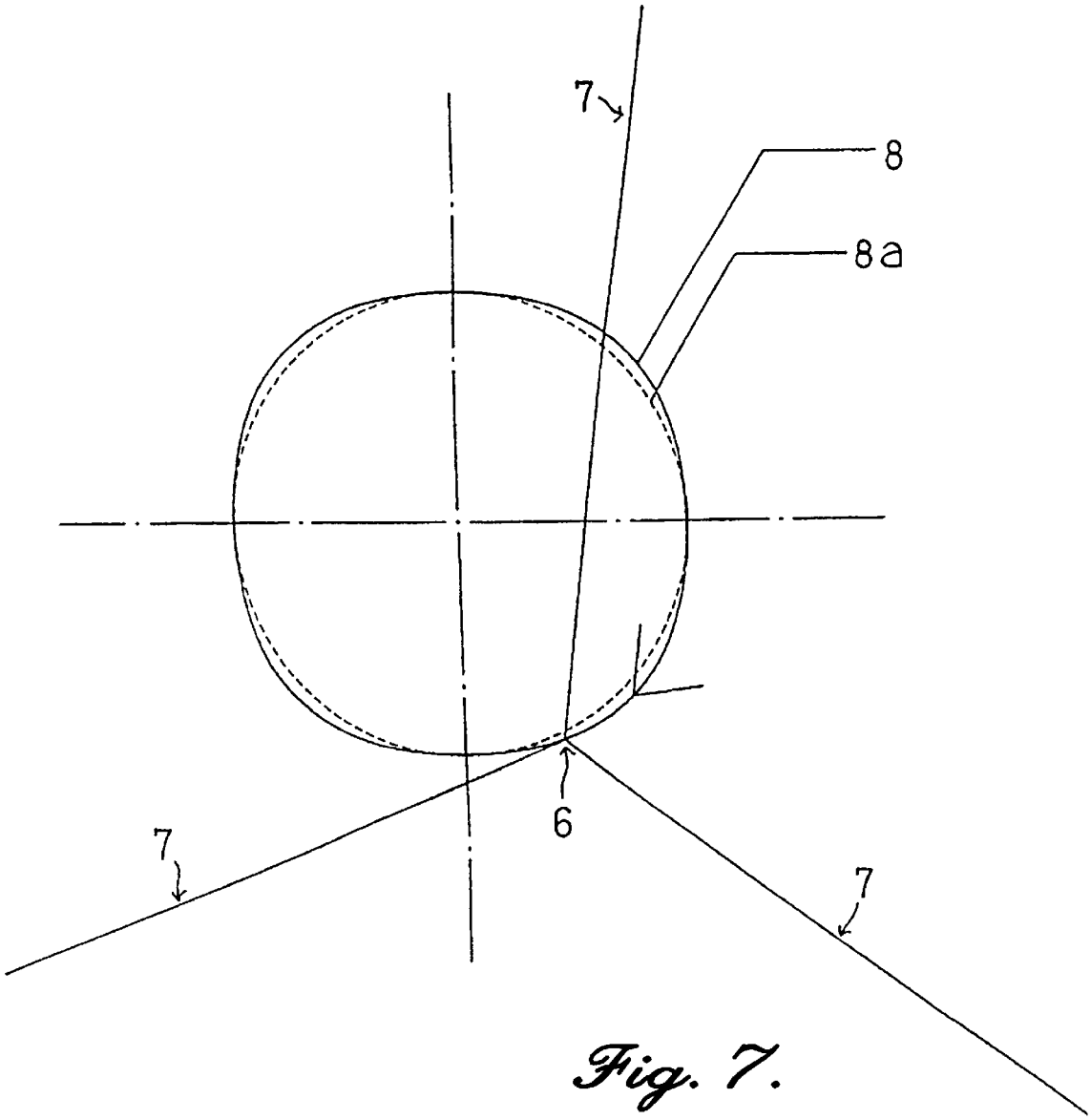
FIG. 7 is a partially enlarged plan view showing a predetermined path of the central axis of door assembly.

Referring to FIG. 7, the central axis 6 of the door assembly 5 has a predetermined path of travel 8 such that the outer ends of the door wings 7 travel along a substantially rectangular predetermined path. The predetermined path 8 shown in FIG. 7 is a closed looped path and a reference circle is indicated by a broken line 8*a*. FIG. 7 merely shows one embodiment of the predetermined path of travel of the central axis and the shape of the predetermined path of travel is not limited to the drawings. The shape of the path may be exactly circular like the reference circle 8*a*. Generally, flexible sealing means is provided at extremities of the door wings 7 so that the sealing means absorbs and adjusts variations of distances between the inner surfaces of the side walls 1 and the extremities of the door wings 7. A predetermined path of the outer ends of door wings is substantially rectangular and has curved corner portions which correspond with the corner portions 1*b* of the side walls 1 so that the inner surfaces of the corner portions 1*b* guide the extremities of the door wings 7 and a space between the outer ends of the door wings 7 and inner surfaces of the side walls 1 (or the inner surfaces of the corner portions 1*b*) is prevented.

Figure 8A:
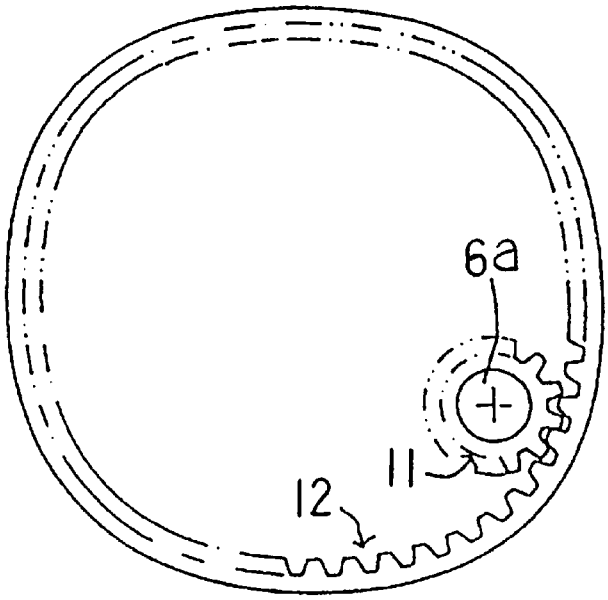
FIG. 8A shows a first embodiment of means for eccentrically revolving the door assembly.
Figure 8B:
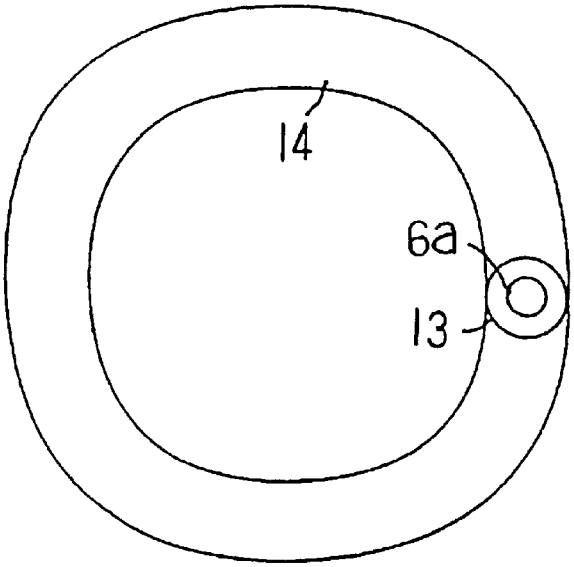
FIG. 8B shows a second embodiment of means for eccentrically revolving the door assembly.
Figure 8C:
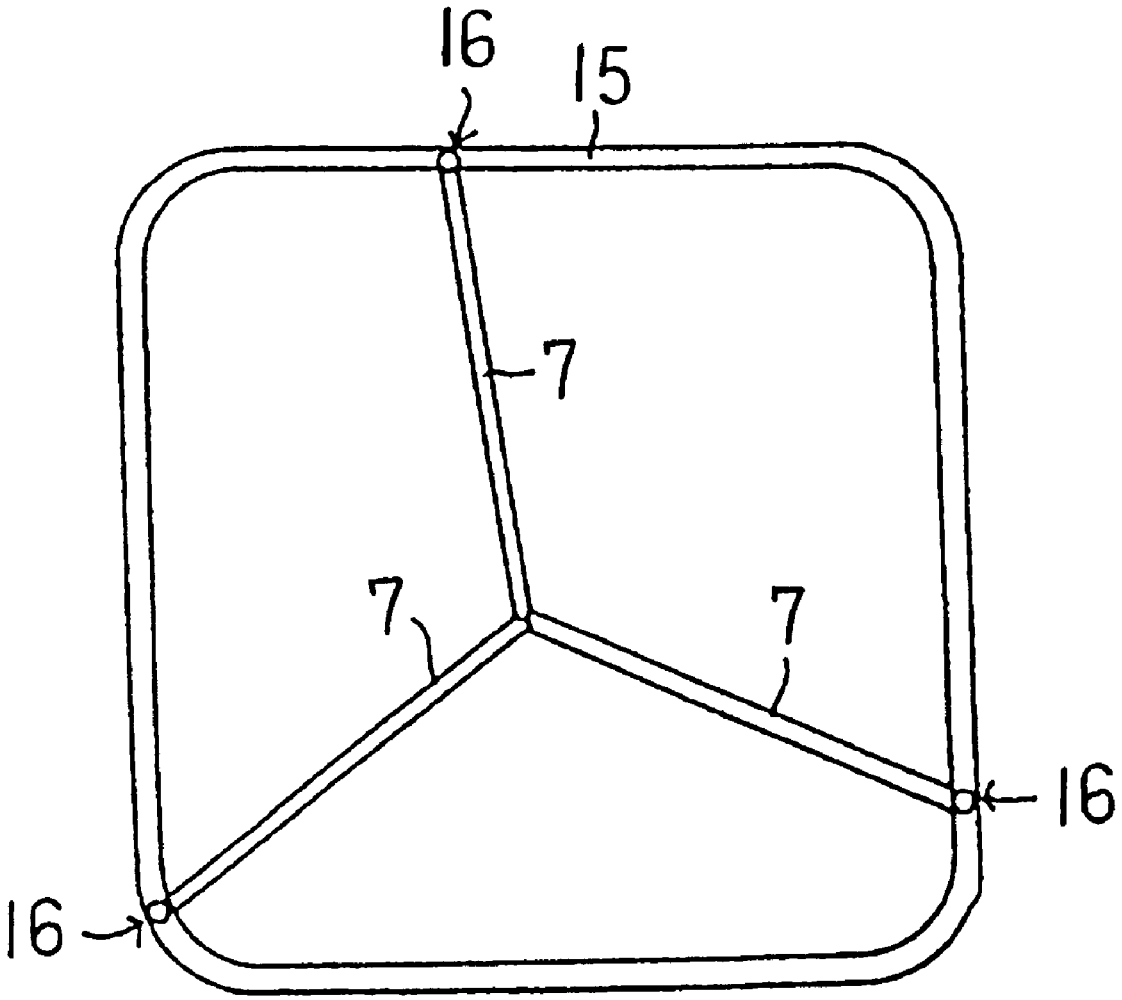
FIG. 8C shows a third embodiment of means for eccentrically revolving the door assembly.
Figure 11A:
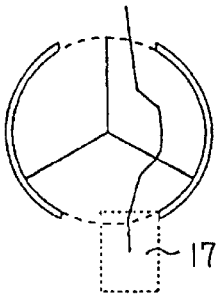
FIGS. 11A through 11K show a path of wheel chair in sequence when the chair moves through the conventional revolving door.
Figure 11B:
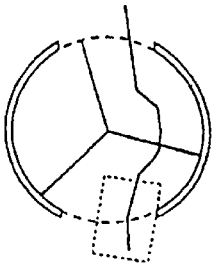
Figure 11C:
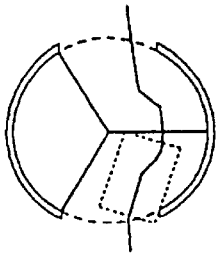
Figure 11D:
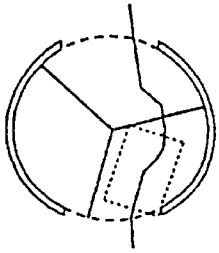
Figure 11E:
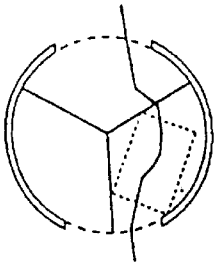
Figure 11F:
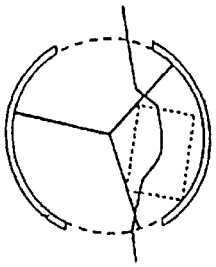
Figure 11G:
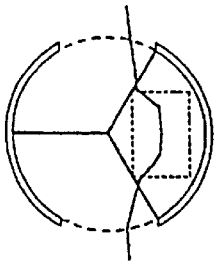
Figure 11H:
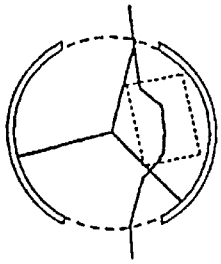
Figure 11I:
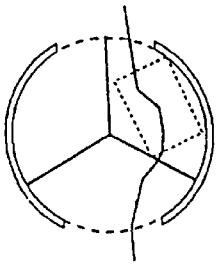
Figure 11J:
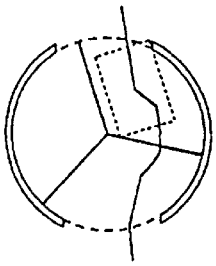
Figure 11K:
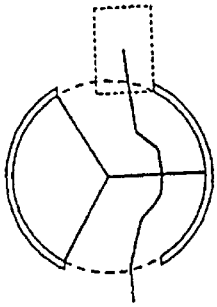

Referring to FIG. 8, there is shown means for eccentrically revolving the door assembly. FIG. 8 shows a first embodiment of the means for eccentrically revolving the door assembly 5 in which the central axis 6 has an extended portion 6*a* extending upwardly from an upper portion of the door assembly 5 and a gear 11 is provided on the extended portion 6*a*. An annular gear 12 which defines a predetermined path of travel of the gear 11 is provided above the door assembly 5. The gear 11 of the extended portion 6*a* travels along the annular gear 12 while the door assembly 5 revolves within the passage space 2. FIG. 8(*b*) shows a second embodiment of the means for eccentrically revolving the door assembly in which the central axis 6 has the extended portion 6*a* extending upwardly from the upper portion of the door assembly 5 and a guide roller 13 is provided on the extended portion 6*a*. An annular guide rail 14 which defines the predetermined path of travel of the guide roller 13 is provided above the door assembly 5. The guide roller 13 travels along the guide rail 14 while the door assembly 5 revolves within the passage space 2. FIG. 8(*c*) shows a third embodiment of the means for eccentrically revolving the door assembly. A closed guide rail 15 which defines a predetermined path of travel of the outer ends of the door wings 7 is provided above the door wings 7. A guide roller 16 is provided at the upper portion of the outer end of each door wing 7 and the guide roller 15 travels along the guide rails 16 while the door wing 7 revolves within the passage space 2. According to the third embodiment, the guide roller 16 and the guide rail 15 can be replaced by a gear and a closed guide rail having an annular gear. Aforementioned means for eccentrically revolving the door assembly may be provided below the revolving door assembly or both above and below the revolving door assembly instead of providing above the revolving door assembly. Means for eccentrically revolving the door assembly is not limited to the embodiments and it is to be understood that other variations, a crank mechanism for example, can be implemented by the ordinary skilled person in the art.

Referring to FIG. 9, there is shown a predetermined path of travel of the door assembly 5 in which revolving directions of the door wing 7 and the central axis 6 are depicted by an arrow respectively. It is apparent from the drawings that the predetermined path of the outer extremities of door wings 7 is substantially rectangular. FIGS. 10 and 11 show a path of a wheel chair 17 when the chair 17 passes through the revolving door in which FIG. 10 corresponds to the present invention and FIG. 11 corresponds to the conventional revolving door. Advantages of the present invention will be apparent by comparing FIG. 10 with FIG. 11. According to the present invention, larger passage openings which define an egress and an ingress of the vestibule can be obtained provided that the size of the door assembly and the width between the opposed side walls are equal. Further, according to the present invention, a relatively straight path of travel which is particularly suited for the wheel chair can be obtained.

Figure 12A:
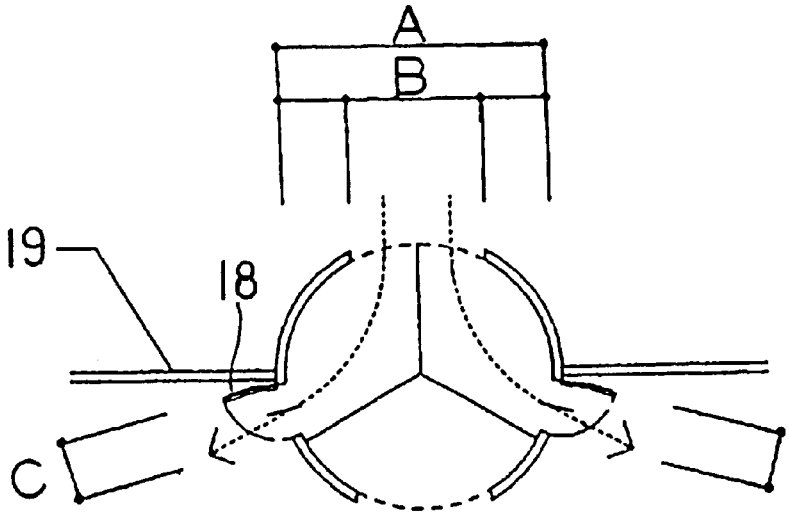
FIG. 12A shows an escape path of the conventional revolving door.
Figure 12B:
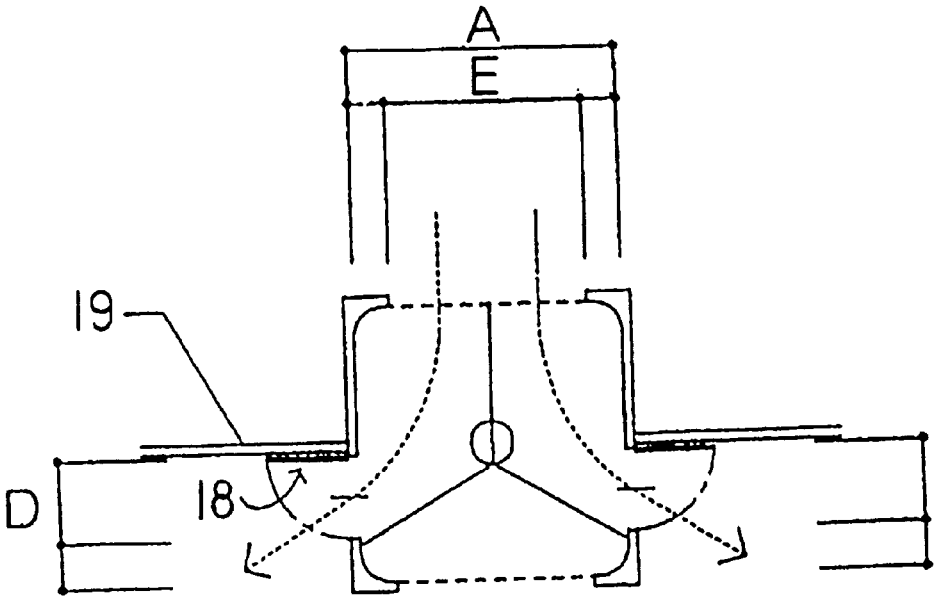
FIG. 12B shows an escape path of the revolving door of the present invention.
Figure 13A:
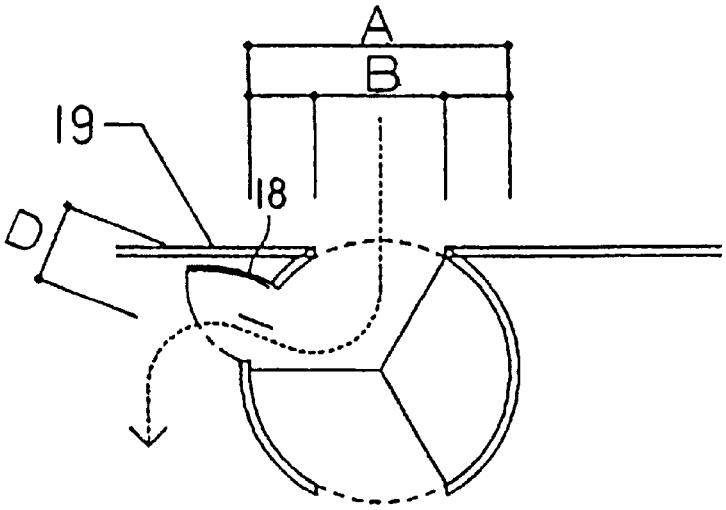
FIG. 13A shows another example of escape path of the conventional revolving door.
Figure 13B:
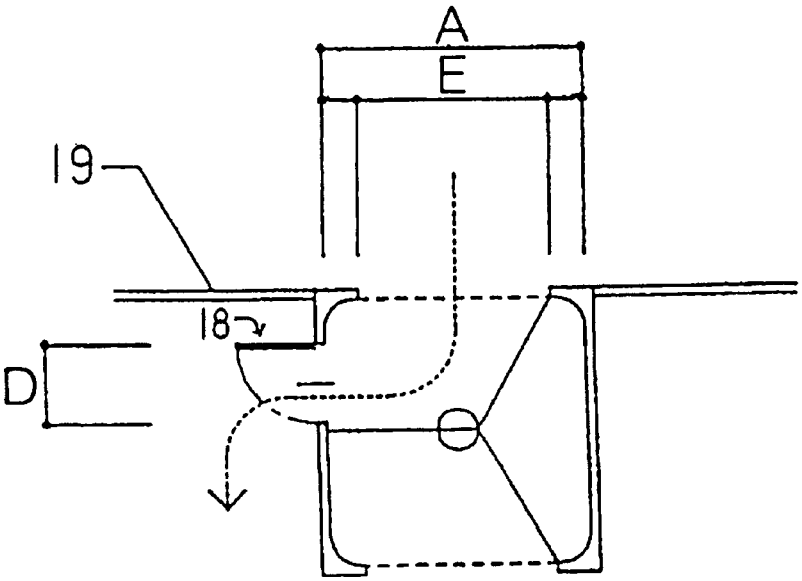
FIG. 13B shows another example of escape path of the revolving door of the present invention.

Referring to FIGS. 12 & 13, emergency doors 18 are provided in the side walls 1 and escape paths of emergency are shown. FIG. 12(*a*) corresponds to the conventional revolving door assembly and FIG. 12(*b*) corresponds to the revolving door of the present invention. FIG. 13 shows another example of the escape paths. In FIGS. 12 and 13, reference 19 denotes a wall which partitions an inside and an outside of the building. With regard to FIGS. 12(*a*) and 13(*a*), an inner diameter of the cylindrical passage space is A and a width of the passage opening is B, and a width of an escape opening is C, D respectively. With regard to FIGS. 12(*b*) and 13(*b*), an inner distance of opposed side walls is A and a width of the passage opening is E (E is larger than B), and a width of the escape opening is D (D is larger than C). It is apparent from the drawings that according to the revolving door of the present invention, a wider escape opening (see FIG. 12) and a smoother escape path (see FIG. 13) can be obtained.

In view of the foregoing, it is apparent that the principles of the present invention can be applied to both a manually driven revolving door assembly and an electrically driven revolving door assembly.

I claim:

1. A revolving door having opposed vertical walls defining a passage space, and a door assembly being horizontally rotatable within the passage space, the door assembly comprising a central axis and a plurality of door wings extending outwardly from the central axis, characterized in that said walls comprise opposed substantially flat surfaces, and said door wings eccentrically revolve within the passage space such that an outer extremity of at least one door wing is always in close sealing proximity with each of said opposed surfaces, respectively.

2. The revolving door as claimed in claim 1 wherein said walls are comprised of opposed vertical substantially flat members.

3. The revolving door as claimed in claim 1 wherein a predetermined path of extremities of the door wings is substantially rectangular.

4. The revolving door as claimed in claim 1 wherein said central axis is forced to travel along a looped predetermined path when said door wings revolve within the passage space.

5. The revolving door as claimed in claim 4 wherein at least one end of the central axis is extended to form an extended portion having a first guide element thereon and wherein said first guide element moves along a second guide element defining the looped predetermined path.

6. The revolving door as claimed in claim 5 wherein said first guide element is a guide roller and wherein said second guide element is a closed guide rail.

7. The revolving door as claimed in claim 5 wherein said fist guide element is a first gear and wherein said second guide element is a closed guide rail having a second gear.

8. The revolving door assembly as claimed in claim 1 wherein said extremities of the door wings are forced to travel along a closed predetermined path when said door wings revolve within the passage space.

9. The revolving door assembly as claimed in claim 8 wherein a first guide element is provided at the extremities of the door wings and wherein said first guide element travels along a second guide element defining the closed predetermined path.

10. The revolving door assembly as claimed in claim 9 wherein said first guide element is a guide roller and wherein said second guide element is a closed guide rail.

11. The revolving door as claimed in claim 1 wherein each wall comprise corner portions at both sides thereof and wherein the corner portions have curved inner surfaces to guide the extremities of the door wings.

12. The revolving door as claimed in claim 1 wherein a vertical sealing member is provided at the extremity of each door wing.

13. The revolving door as claimed in claim 12 wherein said sealing member is a flexible resilient member.

14. The revolving door as claimed in claim 12 wherein said sealing member is retractable.

15. A revolving door having opposed vertical walls defining a passage space, and a door assembly being horizontally rotatable within the passage space, the door assembly comprising a central axis and a plurality of door wings extending outwardly from the central axis, characterized in that said walls comprise opposed substantially flat surfaces, and the door assembly eccentrically revolves about the central axis within the passage space wherein an outer extremity of at least one door wing is always in close sealing proximity with each of said opposed surfaces, respectively.

16. The revolving door as claimed in claim 15, wherein said central axis is guided to travel along a looped predetermined path when said door assembly revolves within the passage space.

17. The revolving door as claimed in claim 15, wherein said extremities of the door wings are constrained to travel along a closed predetermined path when said door assembly revolves within the passage space.

* * * * *

UNITED STATES PATENT AND TRADEMARK OFFICE

CERTIFICATE OF CORRECTION

PATENT NO. : 6,061,960

DATED : May 16, 2000

INVENTOR(S) : N. Korai

It is certified that error appears in the above-identified patent and that said Letters Patent is hereby corrected as shown below:

| COLUMN | LINE | |
|---|---|---|
| [76] | Inventor | "2-Chome," should read –Kagurazaka 2-Chome,-- |

Signed and Sealed this

Eighth Day of May, 2001

*Attest:*

Nicholas P. Godici

NICHOLAS P. GODICI

*Attesting Officer*

*Acting Director of the United States Patent and Trademark Office*